US008136427B2

(12) United States Patent
James

(10) Patent No.: US 8,136,427 B2
(45) Date of Patent: Mar. 20, 2012

(54) WRENCHES

(76) Inventor: Ami James, Miami Beach, FL (US)

( * ) Notice: Subject to any disclaimer, the term of this patent is extended or adjusted under 35 U.S.C. 154(b) by 213 days.

(21) Appl. No.: 12/470,324

(22) Filed: May 21, 2009

(65) Prior Publication Data

US 2010/0293721 A1 Nov. 25, 2010

(51) Int. Cl.
*B25B 13/56* (2006.01)
*B25B 13/02* (2006.01)
*B65D 69/00* (2006.01)

(52) U.S. Cl. ..... 81/119; 81/176.1; 206/223; 206/376

(58) Field of Classification Search ..... 81/124.5, 81/176.1, 119, 124.3; 206/376, 378
See application file for complete search history.

(56) References Cited

U.S. PATENT DOCUMENTS 496,913 A * 5/1893 Shoe ..... 81/119
635,562 A * 10/1899 Marschutz ..... 81/119
849,891 A * 4/1907 Ellingson ..... 81/120
999,399 A * 8/1911 Reeed ..... 81/119
1,001,280 A * 8/1911 Keller ..... 81/119
1,317,399 A * 9/1919 Stoffel ..... 81/442
1,475,353 A * 11/1923 Shapiro et al. ..... 81/15.7
2,083,131 A * 6/1937 Tornebohm ..... 206/376
2,394,845 A * 2/1946 Cothern ..... 7/168
4,327,611 A 5/1982 Catanese et al.
4,517,862 A 5/1985 Garcia
4,530,262 A 7/1985 Pownall
4,995,128 A 2/1991 Montgomery et al.
5,245,721 A 9/1993 Lowe et al.
5,505,316 A * 4/1996 Lee ..... 211/70.6
5,606,896 A 3/1997 Shammout
5,730,303 A * 3/1998 Chow ..... 211/70.6
5,823,077 A 10/1998 Macor
5,931,066 A * 8/1999 Waynick ..... 81/177.2
5,983,759 A 11/1999 Turner
6,039,178 A * 3/2000 Ernst ..... 206/376
6,286,398 B1 9/2001 Huang
6,523,440 B2 * 2/2003 Friedman et al. ..... 81/125.1
6,622,329 B2 9/2003 Ostor et al.
6,820,742 B1 * 11/2004 Chen ..... 206/378
6,886,430 B1 5/2005 Tremblay
6,899,001 B1 5/2005 Sanders et al.
6,988,288 B2 * 1/2006 Wang ..... 7/138
7,093,519 B1 8/2006 Huang
7,143,669 B2 12/2006 Hu
7,178,670 B2 * 2/2007 Chen ..... 206/376
7,182,000 B1 * 2/2007 Dicksen ..... 81/177.2
7,204,176 B2 * 4/2007 Wu ..... 81/177.7
7,530,295 B2 * 5/2009 Jones et al. ..... 81/124.4
7,559,427 B2 * 7/2009 Hu ..... 206/764
7,584,845 B2 * 9/2009 Cheng ..... 206/376
2008/0060960 A1 * 3/2008 Hu ..... 206/376
2008/0163434 A1 * 7/2008 Jones et al. ..... 7/138
2008/0202293 A1 * 8/2008 Hu ..... 81/63.1
2009/0032484 A1 * 2/2009 Hu ..... 211/70.6

* cited by examiner

*Primary Examiner* — David B Thomas
(74) *Attorney, Agent, or Firm* — Parron Law; David W. Barman

(57) ABSTRACT

The invention relates to hand tools that can be used in a variety of projects. Specifically, the invention relates to wrenches having two heads that are useful for repairing many different types of objects. The projects include motorcycle repair, automotive repair, small engine repair, general home repair, and appliance repair.

10 Claims, 10 Drawing Sheets

WRENCHES

FIELD OF THE INVENTION

The invention relates to hand tools that can be used in a variety of projects. Specifically, the invention relates to wrenches having two heads that are useful for repairing many different types of objects. The objects include motorcycles, automobiles, small engines, and appliances. These wrenches may also have utility in home repair and improvement.

BACKGROUND OF THE INVENTION

Combination wrenches, or those wrenches that have more than one working component are known in the tool art. Wrenches of these types can have two wrench heads, or a wrench head and another tool component. For example, U.S. Pat. No. 7,143,669 is a combination of a wrench and a drive member. U.S. Pat. No. 7,093,519 discloses a three-in-one wrench that has a structured ratchet wrench in the center of the wrench body, a socket wrench with opening jaws on one end of the wrench body, and an adjustable mortise-tenon pivotal wrench on the other end. U.S. Pat. No. 6,886,430 is a third combination ratchet and breaker bar wrench. U.S. Pat. No. 6,286,398 is also a combination wrench. Here the wrench heads will pivot if required. Yet another combination wrench is disclosed in U.S. Pat. No. 5,823,077, which teaches a wrench with two heads and a slidable handle. All of these wrenches, however, are fixed together and do not separate into individual components.

According to other conventional designs, different wrenches, socket wrenches, ratchet socket wrenches, or reversible ratchet socket wrenches may be used for turning different sizes of bolts and nuts, or other fastening pairs. Further, for turning bolts and nuts of different sizes, a socket wrench must be used of a full set of hexagon head sockets. When carrying socket wrench and a fill set of hexagon head sockets, a special tool box or the like must be used. It is expensive to prepare a special toolbox, different hand tools and tool accessories.

It would be an advantage to provide a hand tool that has two wrench heads, each situated at opposite distal ends of the tool and on separate handles. The handles can be locked together via a mating connection, and separated when necessary for ease of use. The hand tool provides two matching wrench tools that can be used in concert on two parts of a fastening pair.

It would a further advantage to provide a plurality of hand tools in a kit form, so that a user is able to employ one of the plurality of hand tools as described. Each hand tool, or wrench, set can be used with a fastening pair of a particular size.

BRIEF SUMMARY OF THE INVENTION

The invention relates to a novel wrench that comprises a first handle having a first wrench head and a first neck extending from the first wrench head to a first distal end, a second handle having a second wrench head and a second neck extending from the second wrench head to a second distal end, and a mating connection formed by the first and second handles, the mating connection capable of locking the first and second handles together when the first and second ends are at opposite ends of the wrench.

The invention also relates to a kit comprising a plurality of hand tools and a package to hold the plurality of hand tools, wherein each hand tool comprises a first handle having a first wrench head and a first neck extending from the first wrench head to a first distal end, a second handle having a second wrench head and a second neck extending from the second wrench head to a second distal end, and a mating connection formed between the first and second handles, the mating connection capable of locking the first and second handles together when the first and second ends are at opposite ends of the wrench. The plurality of hand tools in the kit comprise a first hand tool having a first wrench head that is configured to fit a first part of a first fastening pair and a second wrench head that is configured to fit a second part of the first fastening pair and a second hand tool having a first wrench head that is configured to fit a first part of a second fastening pair and a second wrench head that is configured to fit a second part of the second fastening pair.

Other systems, methods, features, and advantages of the present invention will be or will become apparent to one with skill in the art upon examination of the following figures, detailed description and claims. It is intended that all such additional systems, methods, features, and advantages be included within this description, be within the scope of the invention, and be protected by the accompanying claims.

BRIEF DESCRIPTION OF THE DRAWINGS

The invention may be better understood by references to the detailed description when considered in connection with the accompanying drawings. The components in the figures are not necessarily to scale, emphasis instead being placed upon illustrating the principles of the invention. In the figures, like reference numerals designate corresponding parts throughout the different views.

DETAILED DESCRIPTION OF THE INVENTION

Figure 1:
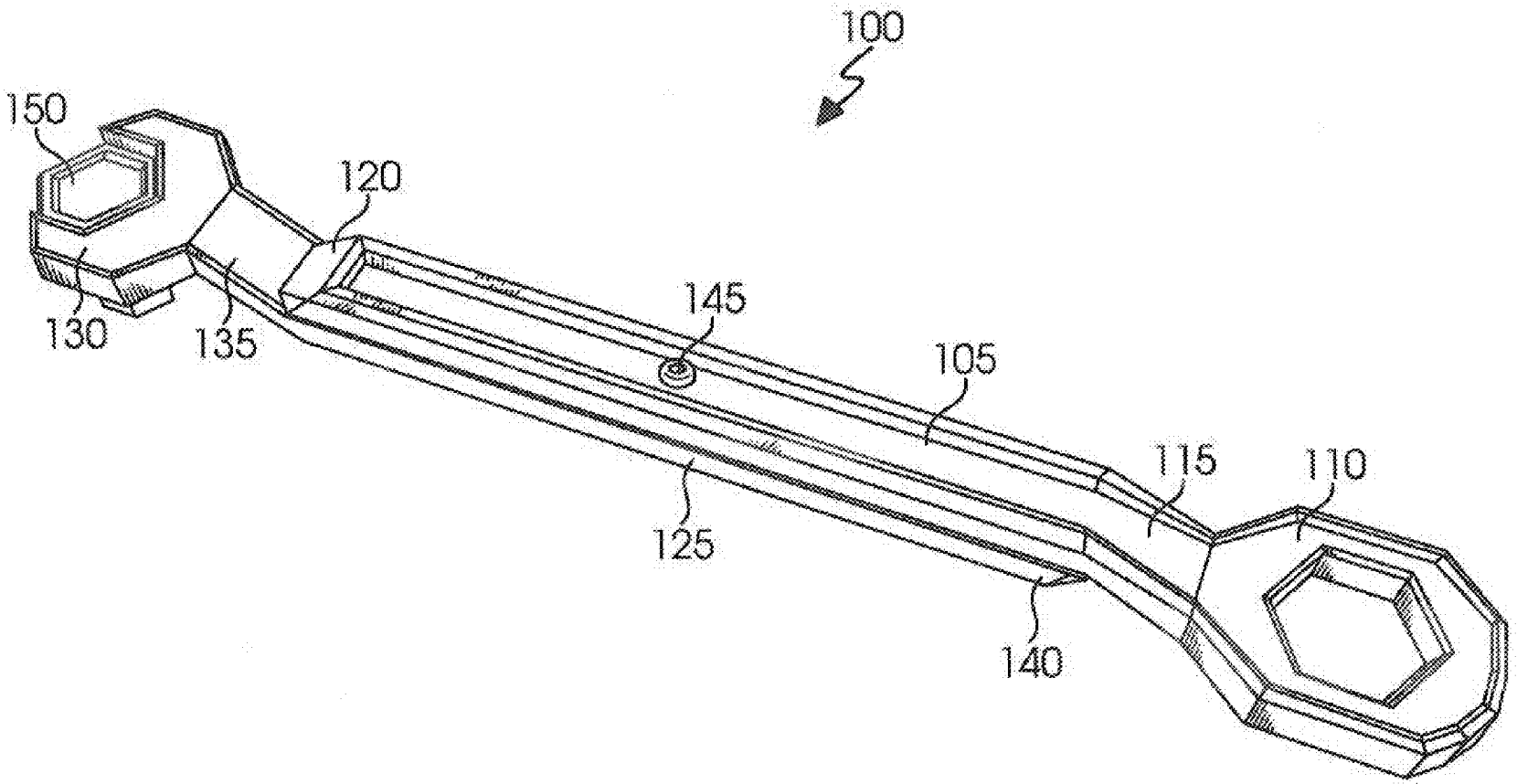
FIG. 1 is a perspective view of the wrench with the first and second handles connected.

The invention relates to a novel wrench that comprises a first handle having a first wrench head and a first neck extending from the first wrench head to a first distal end, a second handle having a second wrench head and a second neck extending from the second wrench head to a second distal end, and a mating connection formed by the first and second handles, the mating connection capable of locking the first and second handles together when the first and second ends are at opposite ends of the wrench.

The invention also relates to a kit comprising a plurality of hand tools and a package to hold the plurality of hand tools, wherein each hand tool comprises a first handle having a first wrench head and a first neck extending from the first wrench head to a first distal end, a second handle having a second wrench head and a second neck extending from the second wrench head to a second distal end, and a mating connection formed between the first and second handles, the mating connection capable of locking the first and second handles together when the first and second ends are at opposite ends of the wrench. The plurality of hand tools in the kit comprise a first hand tool having a first wrench head that is configured to fit a first part of a first fastening pair and a second wrench head that is configured to fit a second part of the first fastening pair and a second hand tool having a first wrench head that is configured to fit a first part of a second fastening pair and a second wrench head that is configured to fit a second part of the second fastening pair.

In many repair instances it is desirable to have a tool set wherein wrench heads are matched for use on a fastening pair. The fastening pair may require complementary wrench heads in order to easily and efficiently tighten or loosen the parts of the pair. For example, a nut and bolt fastening pair can be found on either side of a motorcycle or bicycle tire. The nut would necessitate the use of an open head wrench, while the bolt would necessitate the use of a box wrench. Frequently, it can be difficult to keep track of wrench sets, particularly pairs of wrenches intended to be used together for tightening and/or loosening the parts of a fastening pair.

As seen in FIGS. 1-7, the hand tool 100 comprises a first handle 105 having a first wrench head 110 and a first neck 115 extending from the first wrench head 110 to a first distal end 120, a second handle 125 having a second wrench head 130 and a second neck 135 extending from the second wrench head 130 to a second distal end 140, and a mating connection 145 formed by the first and second handles, 105, 125. The mating connection 145 being capable of locking the first and second handles 105, 125 together when the first and second ends 120, 140 are at opposite ends of the hand tool 100.

Figure 12:
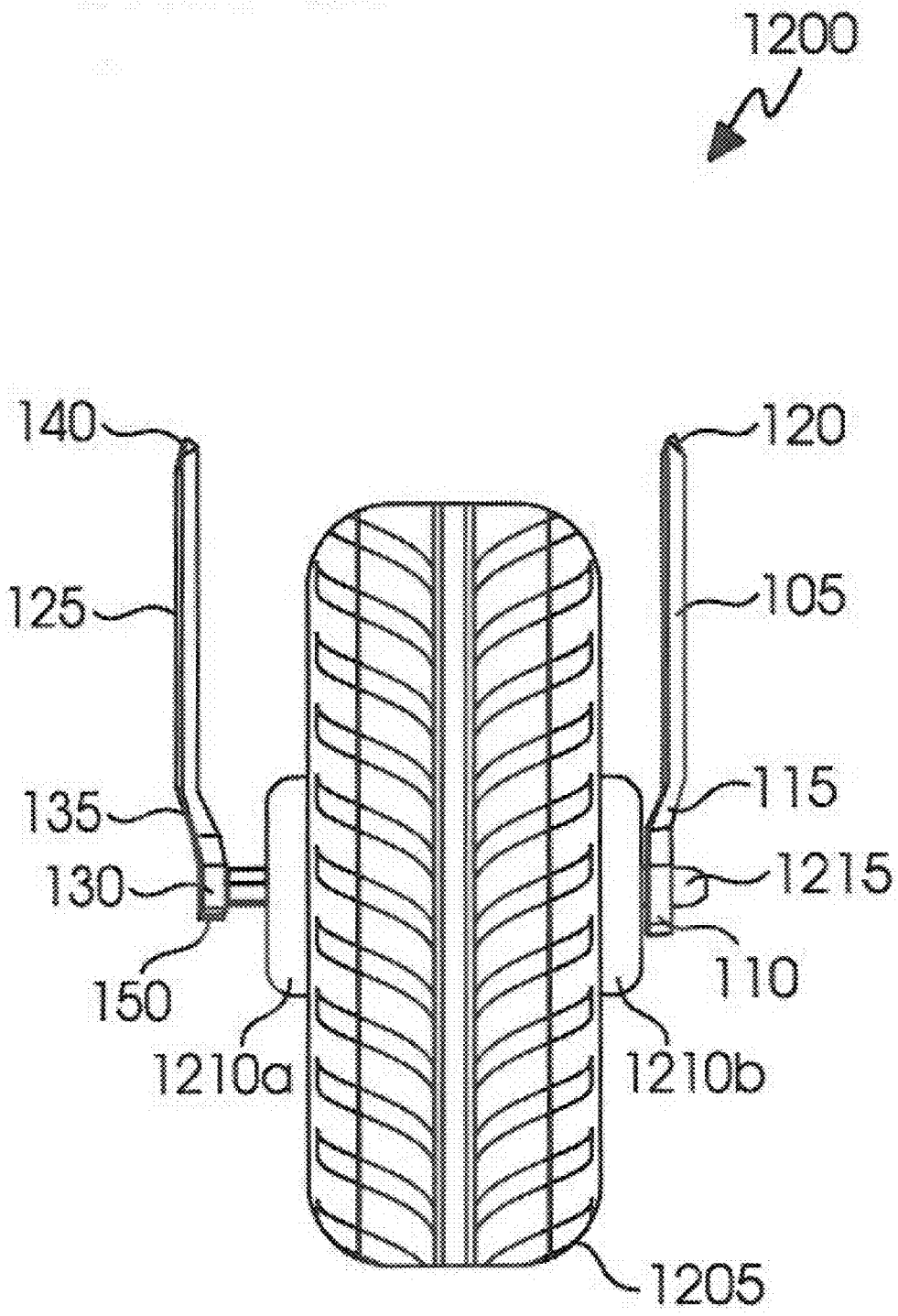
FIG. 12 depicts an illustration of the wrench in use on a fastening pair of a tire.

In FIGS. 1, 2, 4-7, and 12 the second wrench head 130 is being used to tighten or loosen a bolt 150. The bolt 150 may be one of the two elements of a fastening pair, the other element of the fastening pair may be a nut 1215 (as seen in FIG. 12). Other fastening pairs may include a threaded axel and two nuts (such as found in bicycle and motorcycle axels).

Figure 2:
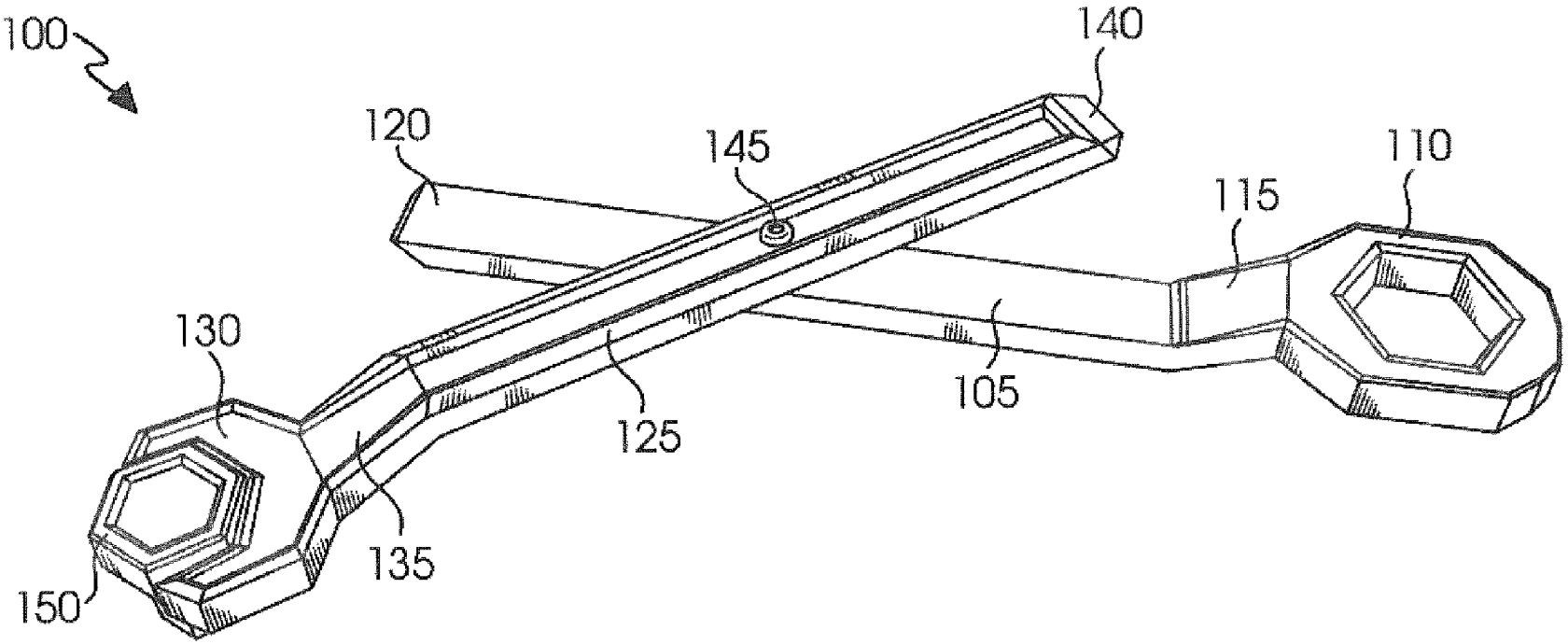
FIG. 2 is a perspective view of the wrench with the first and second handles partially separated.
Figure 3:
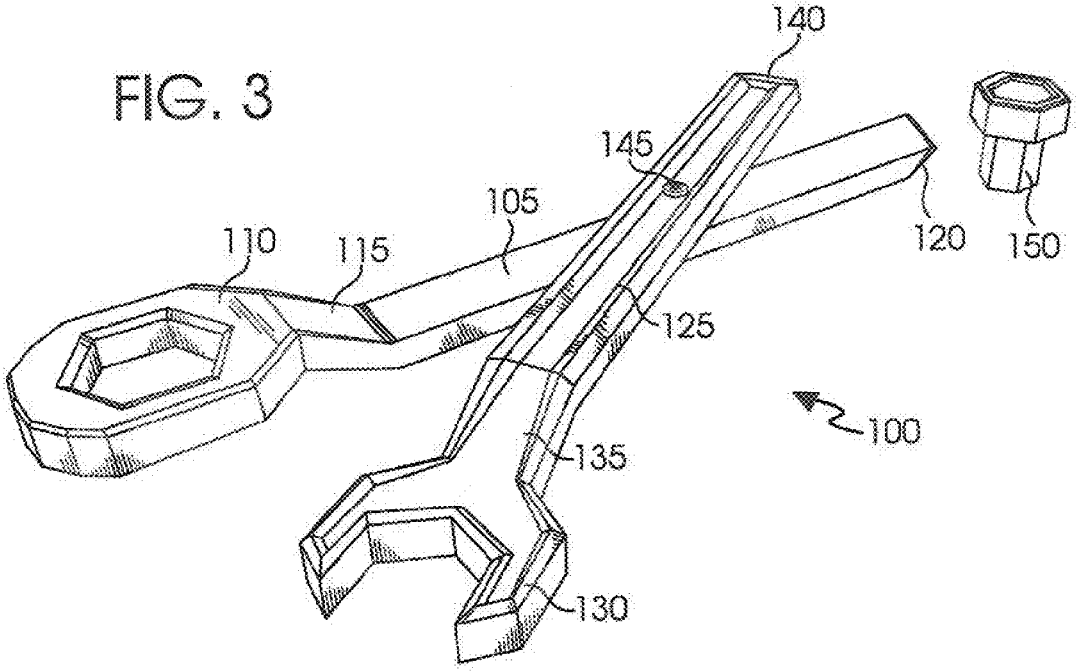
FIG. 3 is another perspective view of the wrench with the first and second handles partially separated.
Figure 4:
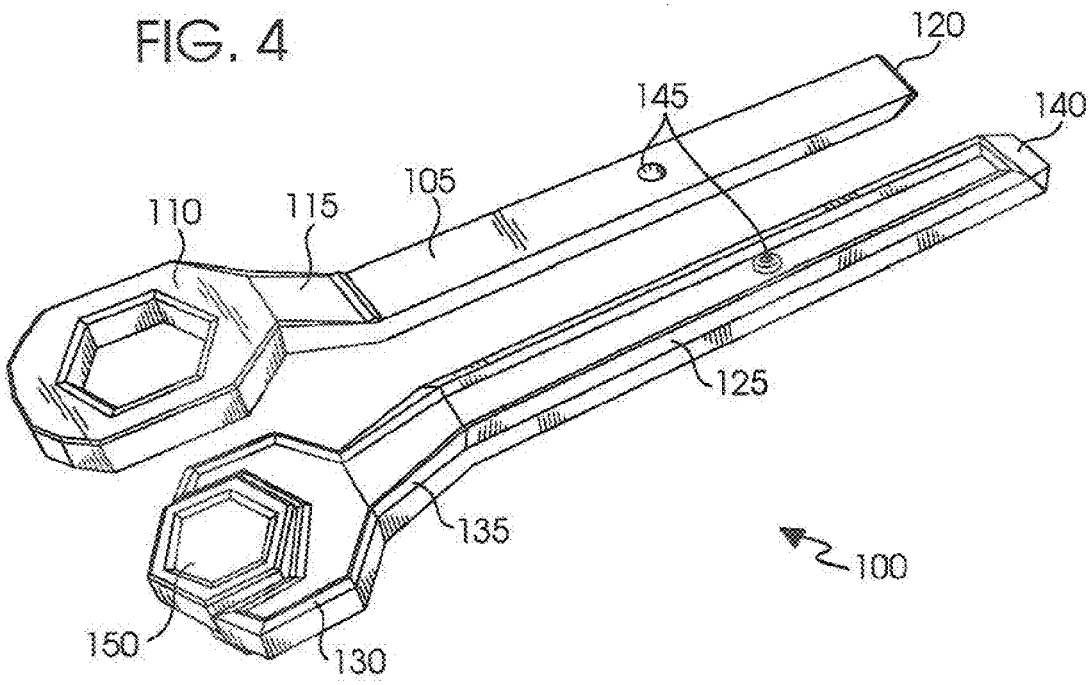
FIG. 4 is a perspective view of the wrench with the first and second handles completely separated.
Figure 5:
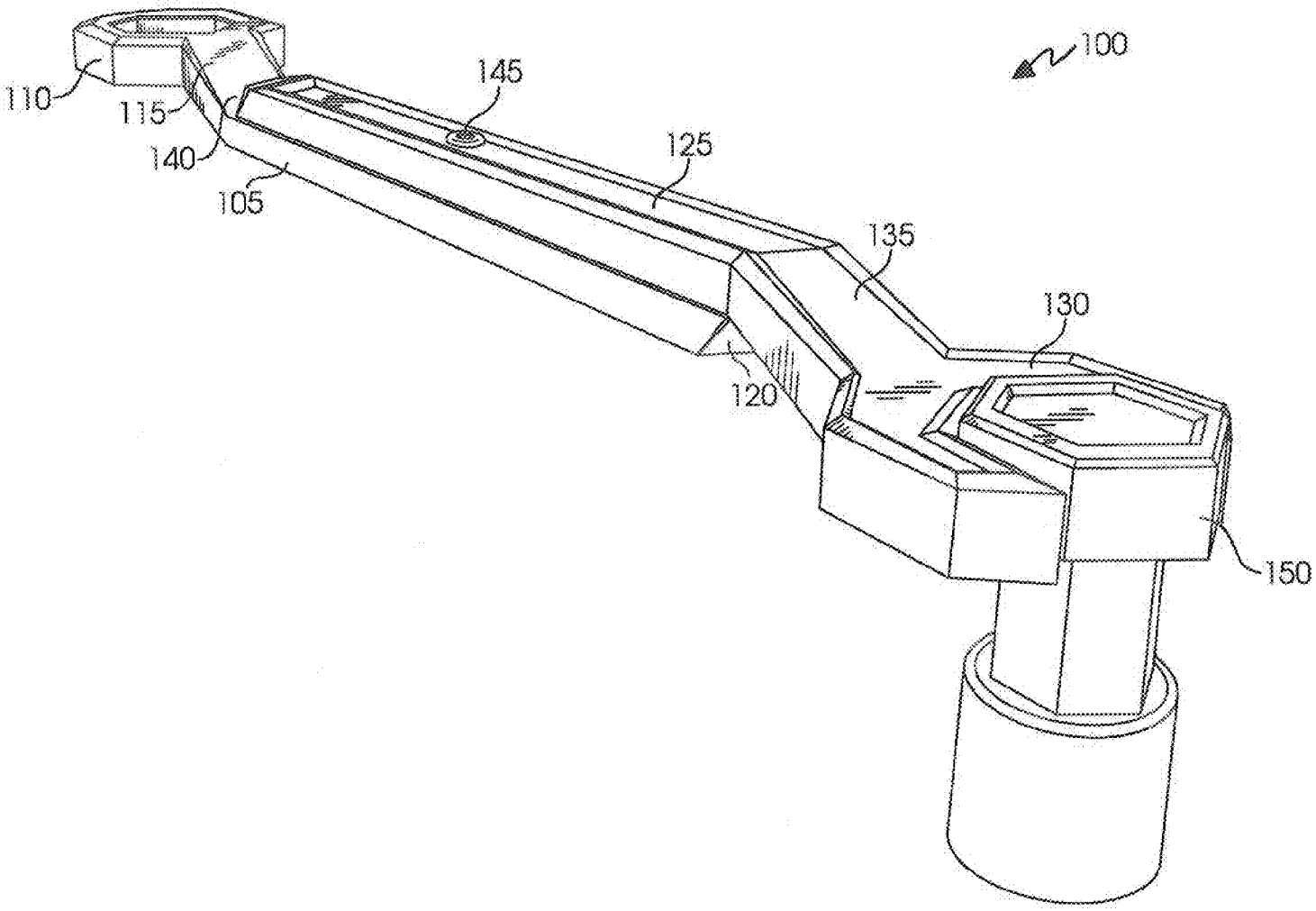
FIG. 5 another view of the wrench in use with the first and second handles connected.
Figure 6:
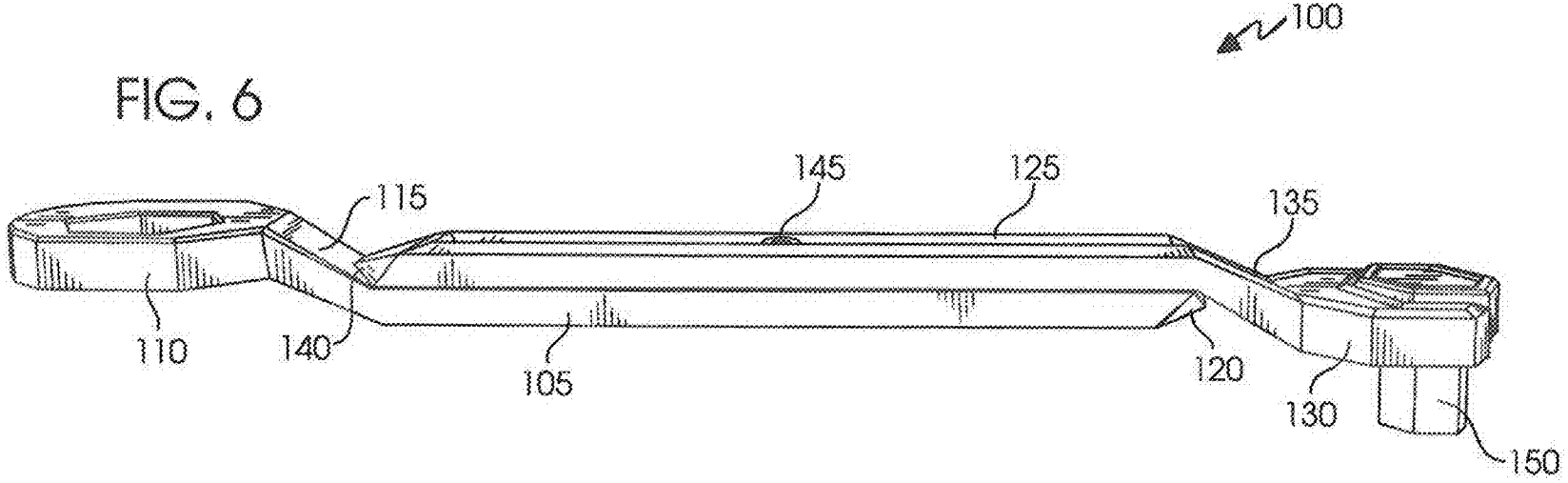
FIG. 6 is a side elevational view of the wrench in use with the first and second handles connected.
Figure 7:
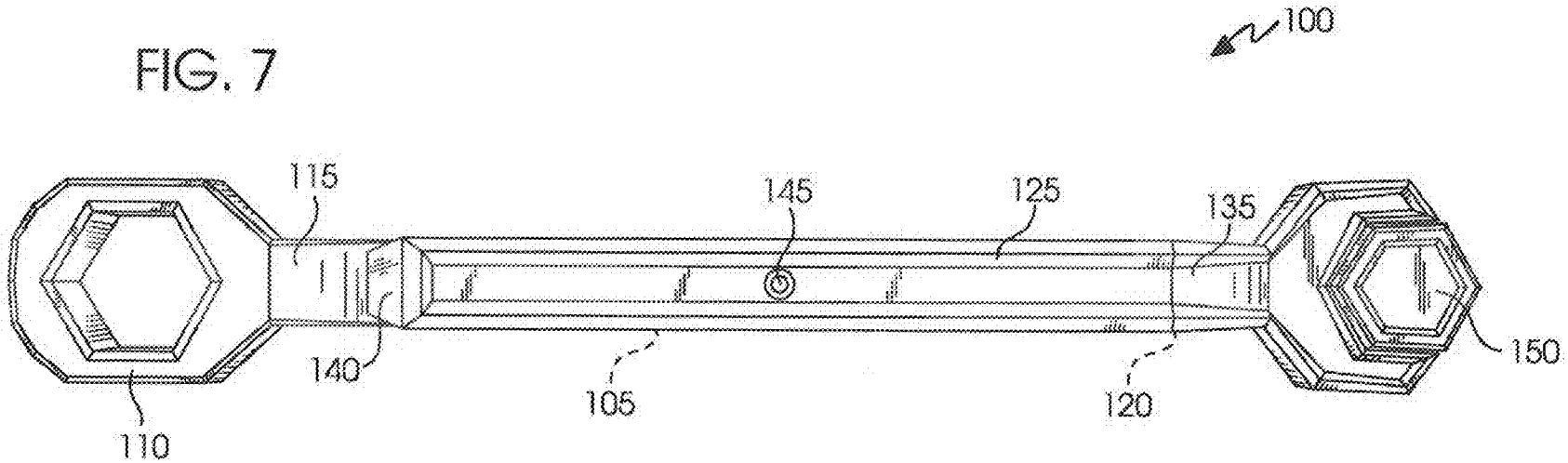
FIG. 7 is a top view of the wrench with the first and second handles connected.
Figure 8A:
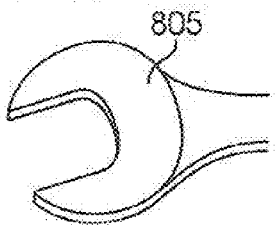
FIGS. 8A-8I depict illustrations of different types of wrench heads that can be included on the first and second handles.
Figure 8E:
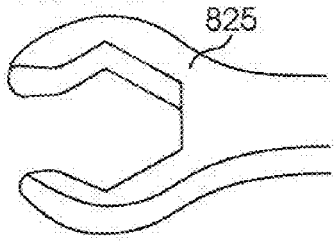
Figure 8F:
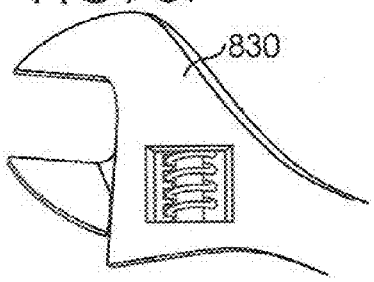
Figure 8B:
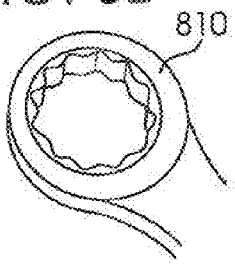
Figure 8G:
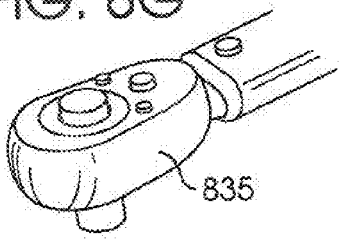
Figure 8C:
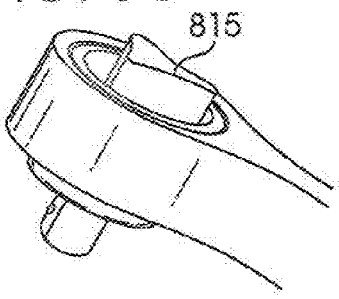
Figure 8H:
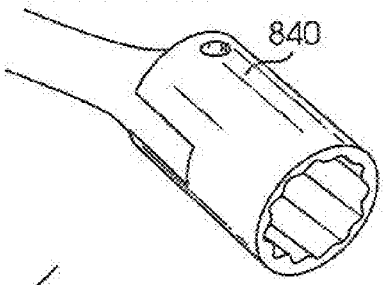
Figure 8D:
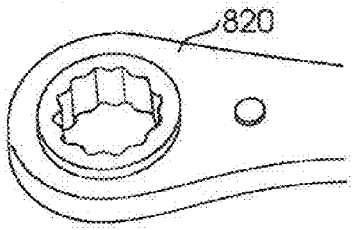
Figure 8I:
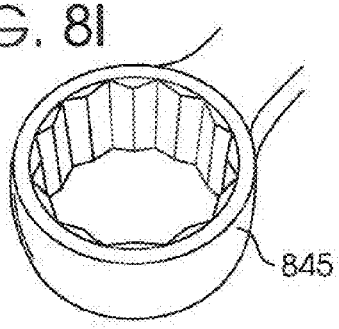
Figure 9A:
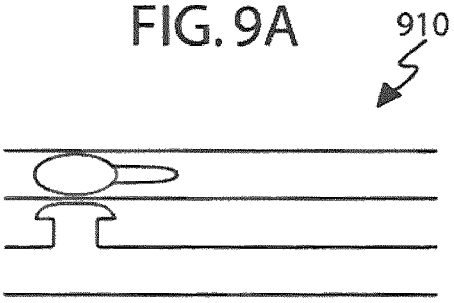
FIGS. 9A-9E depict illustrations of different types of mating connections that can be used to lock the handles together.
Figure 9B:
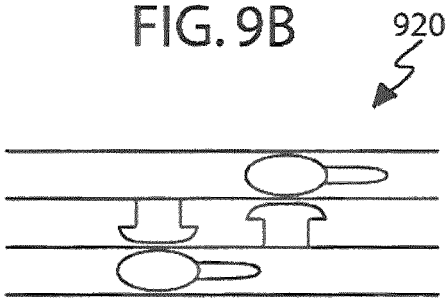
Figure 9C:
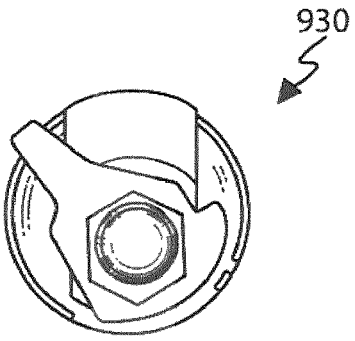
Figure 9D:
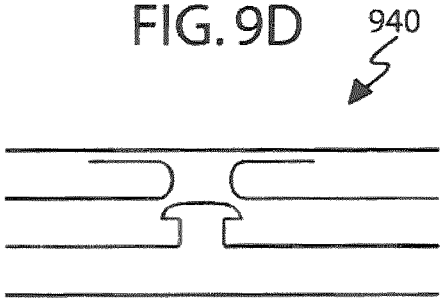
Figure 9E:
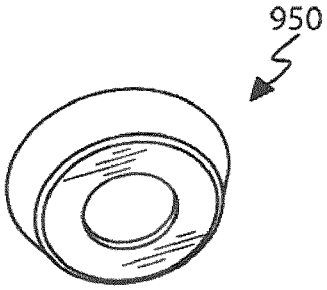

FIG. 1 is an illustration of the hand tool 100 in a locked position. FIGS. 2 and 3 illustrate the wrench 100 in two partially open states. FIG. 4 illustrates the two portions of the wrench 100 in an unlocked and separate state. FIGS. 5-7 show the wrench 100 in a locked configuration.

In general, the hand tool 100 may have the first wrench head 110 and the second wrench head 130 being of the same type. Alternatively, the first wrench head 110 and the second wrench head 130 may be of different types. In one preferred embodiment, the first wrench head 110 is an open end wrench head and the second wrench head 130 is a box wrench head.

In other embodiments, the first wrench head 110 and the second wrench head 130 may be, but is not limited to, an open-end wrench 805, a box wrench 810, a socket wrench 815, a ring spanner 820, a flare-nut wrench 825, an adjustable crescent wrench 830, a torque wrench 835, a saltus wrench 840, and a slogging spanner 845. These wrench head types are shown in FIGS. 8A-8I. Moreover, the first and second wrench heads may be of the same or different sizes. In this regard size refers to the internal diameter of each wrench head 110 and 130, which may be measured the metric, standard or any other measurement format.

The mating connection 145 may be located substantially equidistant from the first wrench head 110 and the second wrench head 130. The mating connection may be, but is not limited to, a single figure eight lock 910, a dual figure eight lock 920, a cam and pin lock 930, a deformable lock 940, and a magnetic lock 950, as shown in FIGS. 9A-9E.

The hand tool 100 may be employed in a wide variety of projects and repairs. The projects may include, but are not limited to, motorcycle repair, automotive repair, small engine repair, general home repair, and appliance repair. Accordingly, it is contemplated that the hand tool 100 will be sold in kits containing a plurality of hand tools (e.g., 100*a*, 100*b*, 100*c*, 100*n*) in various sizes with all of the tools included in a particular kit being clustered around the types of fasteners and fastening pairs that would be encountered during a particular type of project. For instance, the kit could include the particular types of wrench heads and sizes useful in repairing bicycles in general, but could also be focused on a particular type of bicycle (e.g., utility, mountain, racing, touring, etc.). In another for instance, a kit could include the particular types of wrench heads and sizes useful in repairing motorcycles in general, but could also be focused on a particular manufacturer and/or type.

Figure 10:
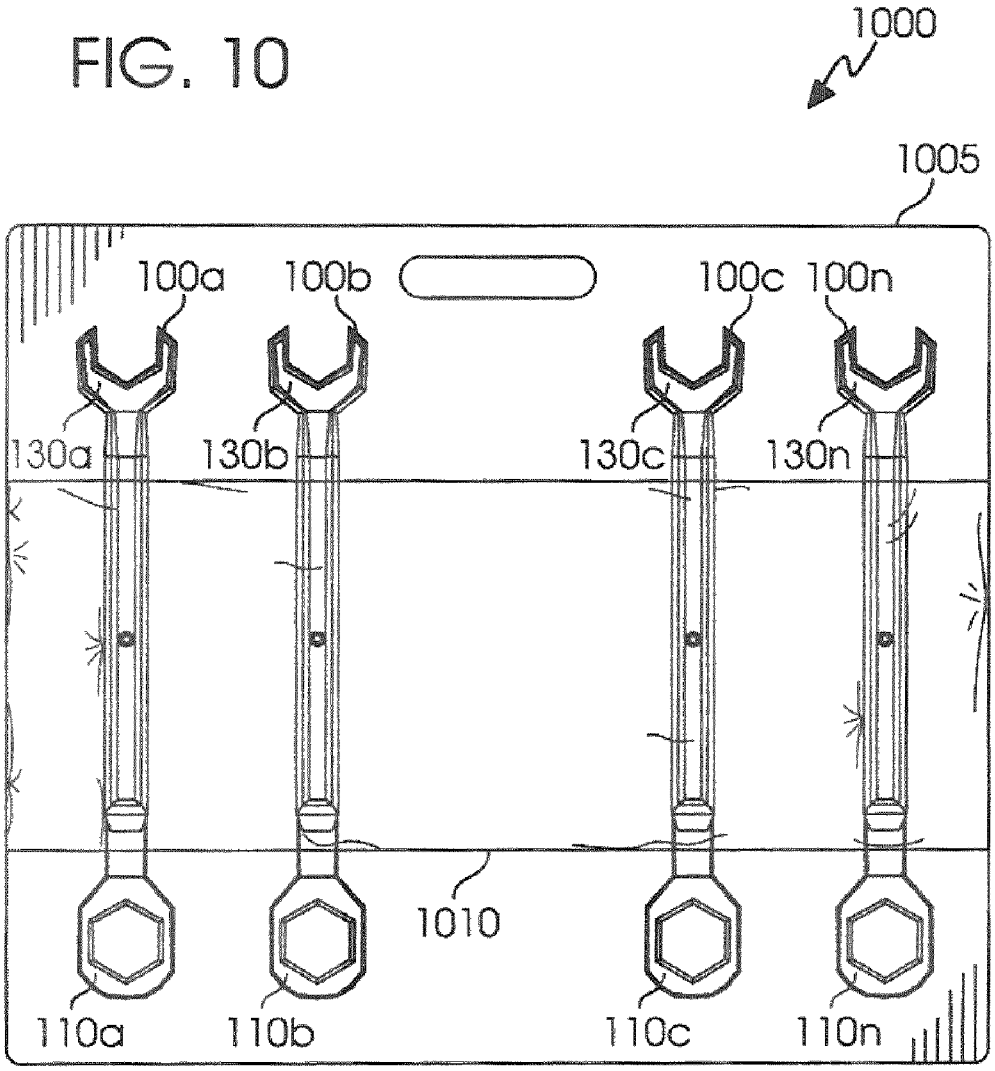
FIG. 10 is an illustration of a plurality of wrenches in a first kit format.

One such kit 1000 is depicted in FIG. 10 as having a plurality of wrenches attached to a backing 1005 via a blister pack 1010. The hand tools, or wrenches 100*a*, 100*b*, 100*c*, 100*n* are depicted in this illustration as having a first wrench head 110*a*, 110*b*, 110*c*, 110*n* that is a box wrench head. The second wrench head 130*a*, 130*b*, 130*c*, 130*n* is an open wrench head. Of course, this selection is merely for purposes of illustration it being understood that depending upon the type of project the kit was intended to address, a variety of tool types will likely be included. Moreover, it is contemplated that the kits may include tools and other desirable things that do not incorporate the novel hand tool design.

Figure 11A:
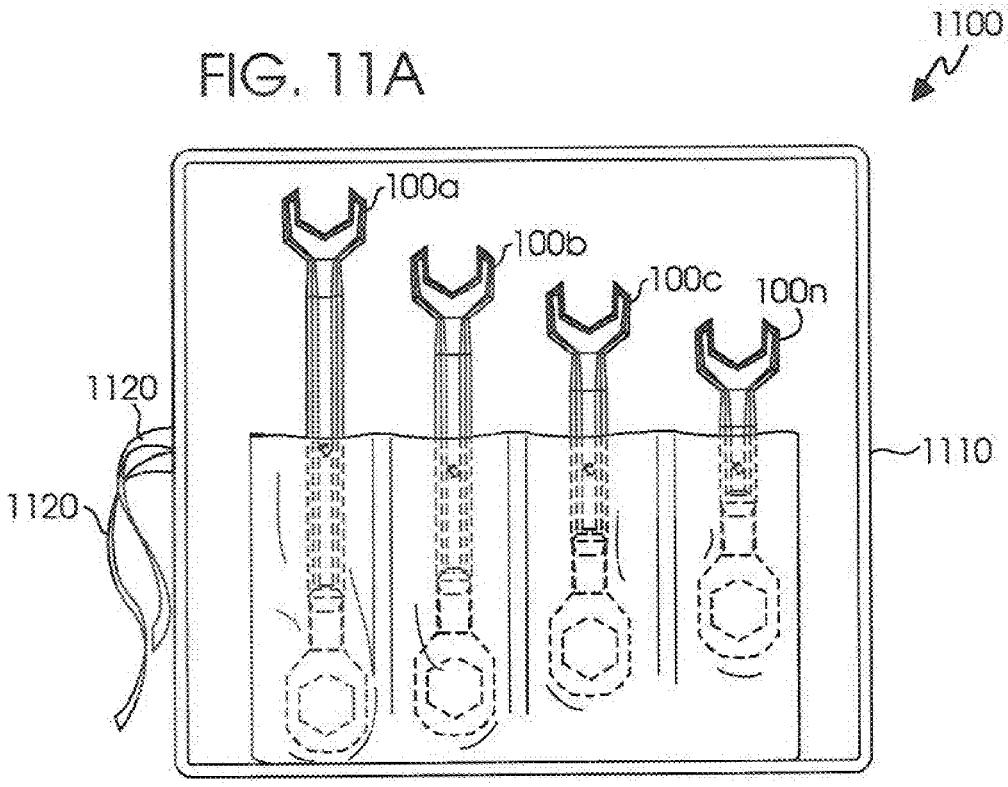
FIGS. 11A-11B are two illustrations of a plurality of wrenches in a second kit format.
Figure 11B:
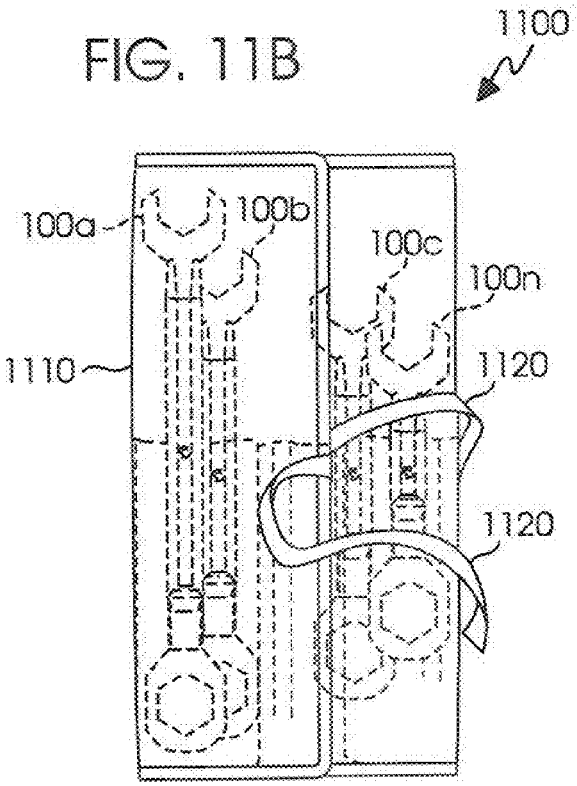

FIGS. 11A-11B depict a second kit embodiment in an open form and a closed form. Here, the plurality of wrenches 100*a*, 100*b*, 100*c*, 100*n* are fit into the pouch 1110 of a cloth holder 1100. FIG. 11 A shows the kit open, so that the wrenches 100*a*, 100*b*, 100*c*, 100*n* may be easily accessed. FIG. 11B shows the kit, wherein the cloth holder 1100 is rolled up for storage or between uses. As in FIG. 9, the hand tools, or wrenches 100*a*, 100*b*, 100*c*, 100*n* are depicted in this illustration as having a first wrench head 110*a*, 110*b*, 110*c*, 110*n* that is a box wrench head. The second wrench head 130*a*, 130*b*, 130*c*, 130*n* is an open wrench head. The cloth holder may be secured by ties 1120.

FIG. 12 illustrates the use of the wrench 100 for performing repair on a tire 1205. Specifically, on a first side of a tire 1205, the first wrench head 100, which here is a box wrench head, is used to tighten or loosen a nut 1215. The nut 1215 is a first part of a fastening pair. On the opposite side of the tire 1205, the second wrench head 130 is used for tightening and loosening the bolt 150, which is the second part of a fastening pair. The type of use—with opposing nuts needing to be counter-biased—is the ideal job for the hand tool 100, but other tasks are made easier.

The foregoing description and drawings merely explain and illustrate the invention and the invention is not limited thereto. While the specification in this invention is described in relation to certain implementation or embodiments, many details are set forth for the purpose of illustration. Thus, the foregoing merely illustrates the principles of the invention. For example, the invention may have other specific forms without departing from its spirit or essential characteristic. The described arrangements are illustrative and not restrictive. To those skilled in the art, the invention is susceptible to additional implementations or embodiments and certain of these details described in this application may be varied considerably without departing from the basic principles of the invention. It will thus be appreciated that those skilled in the art will be able to devise various arrangements, which, although not explicitly described or shown herein, embody the principles of the invention and, thus, are within its scope and spirit.

What is claimed is:

1. A kit comprising: a plurality of hand tools, wherein each hand tool comprises: a first handle having a first wrench head and a first neck extending from the first wrench head to a first distal end; a second handle having a second wrench head and a second neck extending from the second wrench head to a second distal end; and a separable mating connection formed by the first and second handles, the mating connection capable of locking the first and second handles together when the first and second ends are at opposite ends of the wrench and said mating connection capable of separating each of said first and second handles; and a package to hold the plurality of hand tools, wherein said plurality of hand tools comprises: a first hand tool having a first wrench head that is configured to fit a first part of a first fastening pair and a second wrench head that is configured to fit a second part of the first fastening pair; and a second hand tool having a first wrench head that is configured to fit a first part of a second fastening pair and a second wrench head that is configured to fit a second part of the second fastening pair.

2. The kit of claim 1, wherein the first wrench head and the second wrench head of each of the hand tools are the same type.

3. The kit of claim 2, wherein the first wrench head and the second wrench head of each of the hand tools are of different sizes.

4. The kit of claim 3 wherein the first wrench head type and the second wrench head type of each of the hand tools are selected from the group consisting of a an open-end wrench, a box wrench, a socket wrench, a ring spanner, a flare-nut wrench, an adjustable crescent wrench, a torque wrench, a saltus wrench, and a slogging spanner.

5. The kit of claim 1, wherein the first wrench head and the second wrench head of each of the hand tools are different types.

6. The kit of claim 5, wherein the first wrench head and the second wrench head of each of the hand tools are of different sizes.

7. The kit of claim 5, wherein the mating connection of each of the hand tools is located substantially equidistant from the first wrench head and the second wrench head.

8. The kit of claim 5, wherein the first wrench head type and the second wrench head type of each of the hand tools are selected from the group consisting of a an open-end wrench, a box wrench, a socket wrench, a ring spanner, a flare-nut wrench, an adjustable crescent wrench, a torque wrench, a saltus wrench, and a slogging spanner.

9. The kit of claim 1, wherein the mating connection of each of the hand tools is selected from the group consisting of a single figure eight lock, a dual figure eight lock, a cam and pin lock, a deformable lock, and a magnetic lock.

10. The kit of claim 1, wherein the plurality of tools are designed for use in different project types; wherein the project types are selected from the group consisting of motorcycle repair, automotive repair, small engine repair, general home repair, and appliance repair.

* * * * *